US007246576B2

(12) United States Patent
Schiestl et al.

(10) Patent No.: US 7,246,576 B2
(45) Date of Patent: Jul. 24, 2007

(54) COMBUSTION-ENGINED SETTING TOOL

(75) Inventors: Ulrich Schiestl, Feldkirch (AT); Iwan Wolf, Chur (CH); Mario Zahner, Chur (CH); Hans Gschwend, Buchs (CH); Stefan Petkov, Buchs (CH); Peter Hertlein, Gams (CH); Ulrich Rosenbaum, Wangs (CH)

(73) Assignee: Hilti Aktiengsellschaft, Schaan (LI)

( * ) Notice: Subject to any disclaimer, the term of this patent is extended or adjusted under 35 U.S.C. 154(b) by 0 days.

(21) Appl. No.: 11/225,728

(22) Filed: Sep. 12, 2005

(65) Prior Publication Data

US 2006/0054116 A1 Mar. 16, 2006

(30) Foreign Application Priority Data

Sep. 11, 2004 (DE) ..... 10 2004 043 955

(51) Int. Cl.
*B25C 1/04* (2006.01)

(52) U.S. Cl. ..... 123/46 H; 123/46 R

(58) Field of Classification Search ..... 123/46 H, 123/46 R

See application file for complete search history.

(56) References Cited

U.S. PATENT DOCUMENTS 6,378,288 B1 * 4/2002 Towfighi et al. ..... 60/39.6
6,425,354 B1 * 7/2002 Buchel et al. ..... 123/46 R
6,460,507 B2 * 10/2002 Thieleke et al. ..... 123/260
6,463,894 B2 * 10/2002 Hasler et al. ..... 123/46 R
6,520,127 B1 * 2/2003 Thieleke et al. ..... 123/46 R
6,526,926 B1 * 3/2003 Towfighi ..... 123/46 R
6,532,917 B2 * 3/2003 Thieleke et al. ..... 123/46 SC
6,892,524 B1 * 5/2005 Van Erden et al. ..... 60/39.6
6,968,811 B2 * 11/2005 Rosenbaum ..... 123/41.2
2001/0006045 A1 * 7/2001 Thieleke et al. ..... 123/46 R
2003/0230256 A1 * 12/2003 Doherty et al. ..... 123/46 R

* cited by examiner

*Primary Examiner*—Stephen K. Cronin
*Assistant Examiner*—Jason Benton
(74) *Attorney, Agent, or Firm*—Abelman, Frayne & Schwab

(57) ABSTRACT

A combustion-engined setting tool for driving fastening elements such as, e.g., nails, blots, etc. in constructional components includes a combustion chamber (13) for combusting therein an oxidant-fuel mixture, a turbulence generating element, arranged in the combustion chamber (13) for creating turbulence of the oxidant-fuel mixture, and a drive for at least partially driving the turbulence generating element (32) and including a mechanical device (30) for a pulsed acceleration of the turbulence generating element (32) and which is activated by the actuation switch (35) that actuates the setting process.

20 Claims, 7 Drawing Sheets

COMBUSTION-ENGINED SETTING TOOL

BACKGROUND OF THE INVENTION

1. Field of the Invention

The present invention relates to a combustion-engined setting tool for driving fastening elements such as, e.g., nails, bolts, and the like and includes an actuation switch for actuating a setting process, a combustion chamber for combusting therein an oxidant-fuel mixture, turbulence generating means arranged in the combustion chamber for creating turbulence of the oxidant-fuel mixture, and drive means for at least partially driving the turbulence generating means.

2. Description of the Prior Art

In the setting tools of the type described above, a portion of liquid gas or another vaporable fuel, which is mixed with an oxidant, e.g., environmental air, is combusted in the tool combustion chamber. In order to obtain as high as possible drive-in energy from the combustion process, it is important that the combustion of the gas or gas mixture takes place under turbulent flow conditions. Only a turbulent combustion permits to obtain a necessary drive energy from the combustion process, producing a sufficiently rapid pressure increase in the combustion chamber for accelerating the setting piston to a degree necessary for driving a fastening element in. With a laminar combustion, the combustion process and the resulting pressure increase take place so slow that only a fraction of the required mechanical energy can be obtained from the combustion process.

European Patent EP 0 711 634B1 discloses a combustion-engined setting tool having a combustion chamber for combusting an air-fuel gas mixture and in which there is provided ventilator means for creating turbulence. The ventilator means is driven by an electric motor that is supplied with electrical energy from a battery.

The drawbacks of the described tool consists in an increased weight because of addition of the battery or accumulator, and in a need to replace them when their electrical energy expires.

German Publication DE 199 62 711 A1 discloses a combustion-engined setting tool in which a separation plate with through-openings is arranged in the combustion chamber, dividing the combustion chamber in two chambers. An adjustment device is used for changing the distance between the separation plate and a rear wall that axially limits the combustion chamber, whereby the volumes of the forechamber and the main chamber change. In the forechamber, a first portion of the air-fuel mixture is ignited, with the flame jets penetrating into the main chamber through the openings in the separation plate, creating turbulence in the main chamber and igniting the air-fuel mixture therein.

The drawback of the tool disclosed in DE 199 62 711 A1 consists in that the combustion process is sensible to the environmental conditions such as, e.g., temperature, scavenging ratio of the combustion chamber or of the environmental pressure. This results from the fact that the turbulence generation takes place as a result of the combustion process itself, i.e., when the combustion in the forechamber is poor, then the combustion in the main chamber is even worse.

German Publication DE 102 26 878 A1 discloses a combustion-engined setting tool in which, as in the previously described case, the turbulence is generated by a perforated separation plate that remains static before and during the ignition process. After the combustion process ends, the separation plate and the rear wall are displaced in a direction toward the piston guide, so that the combustion chamber completely collapses. After the combustion chamber has collapsed, another, non-perforated plate is displaced as a result of application thereto a spring-biasing force from a location at the rear end of the setting tool remote from the piston guide up to the rear wall in order to scavenge the space before this plate with fresh air.

Here, likewise, the drawback consists in that the combustion process is sensible to the fluctuations of the environmental conditions such as, e.g., temperature, scavenging ratio of the combustion chamber or environmental pressure.

The object of the present invention is to provide a setting tool of the type described in above and in which the drawbacks of the known tools are eliminated.

Another object of the present invention is to provide a setting tool of the type described above which would have a high energy efficiency.

SUMMARY OF THE INVENTION

These and other objects of the present invention, which will become apparent hereinafter, are achieved by providing a setting tool the drive means of which includes a mechanical device for a pulsed acceleration of the turbulence generating means and which is actuated by the actuation switch that actuates the setting process.

The present invention permits to create turbulence in the combustion chamber without using the electrical energy and which is noticeably stronger than the turbulence which is generated by the passage of flame jets through the openings in the separation plate. In particular, according to the invention, the turbulence is generated in the entire combustion chamber and not only in a portion of the combustion chamber. Further, there is no noticeable time delay between actuation of the actuation switch and the setting process. The pulsed acceleration provides for displacement of the turbulence generating means within a range from 1 to 200 msec, preferably from 5 to 100 msec. Further, the displacement or the operation of the turbulence generating means for a such short period of time does not require much energy. With a mass of the turbulence generating means from about 1 to 200 g the energy of only from about 1 mJ to 1 J is needed. Because of the low energy requirement, it can be obtained by conversion of the press-on movement of the setting tool against a constructional component in to a mechanical energy of the mechanical device, without excessively tiring the setting tool operator.

A further advantage of the selling tool according to the present invention consists in that it provides for carrying out rapidly following one another setting processes.

It is beneficial when the mechanical device imparts a pulsed acceleration in a range from 1 $m/s^2$ to 5,000 $m/s^2$ to the turbulence generating means. This permits to achieve very short acceleration time periods and high displacement speeds of the turbulence generating means. It is particularly advantageous when the mechanical device imparts to the turbulence generating means a pulsed acceleration of at least 25 $m/s^2$, in particular, of about 60 $m/s^2$.

Advantageously, the mechanical device includes a force storing element that can be loaded when the setting tool is pressed against a constructional component. Advantageously, the force storing component is formed as a spring element. Such a spring element only slightly increases the necessary press-on force, producing no inconvenience for the setting tool operator.

It is beneficial when the force storing element applies an acceleration force from 1 to 50 N to the turbulence generating means. With such a force storing element, the inventive acceleration values can be easily achieved, without any additional measures.

Advantageously, the press-on element is formed as a rod with which the force storing element is loaded. With such press-on element, the force or energy, which is produced by the press-on movement, can be easily introduced mechanically into the force storing element.

Advantageously, the turbulence generating means is displaced in the combustion chamber substantially friction-free. Thereby, no energy losses or braking of the turbulence generating means occurs because of friction during the displacement of the turbulence generating means in the combustion chamber. In order to obtain a substantially friction-free guidance, a sufficiently large clearance can be provided in all of support/sliding locations and/or special materials with low friction coefficients can be used. There also exists a possibility of using stationary turbulence generating means.

According to one of advantageous embodiments of the present invention the turbulence generating means is formed as a turbulence generating plate provided with through-openings and axially displaceable in the combustion chamber. The turbulence generating plate can be guided along an axially extending tube or rod arranged in the combustion chamber or be connected with the force storing element, without any displacement. The through-openings can be formed as slots or holes. The turbulence generating plate can be formed also as a mesh plate. Further, the turbulence generating plate can be formed as a bulged plate, with the concave tide of the turbulence generating plate falling, preferably, in the direction of the pulsed movement. Such a turbulence generating plate has a high aerodynamic drag value and thereby produces a large turbulence at a rapid displacement. It should be understood that with a collapsed combustion chamber, the displacement of the turbulence generating plate only possible at least in the partially expanded condition of the combustion chamber.

According to a further advantageous embodiment of the present invention, the turbulence generating means is formed as a rotatable stirring element. This stirring element is driven, e.g., by a mechanical device formed, e.g., as a spring drive with a free run, with the spring drive being formed by a spring element which also functions as the force storing element. Such stirring element has a high aerodynamic drag value and has an advantage that consists in that the stirring element still runs after the pulsed acceleration has ended.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

A setting tool 10 according to the present invention, which is shown in FIGS. 1–6, operates on a liquid or gaseous fluid.

Figure 1:
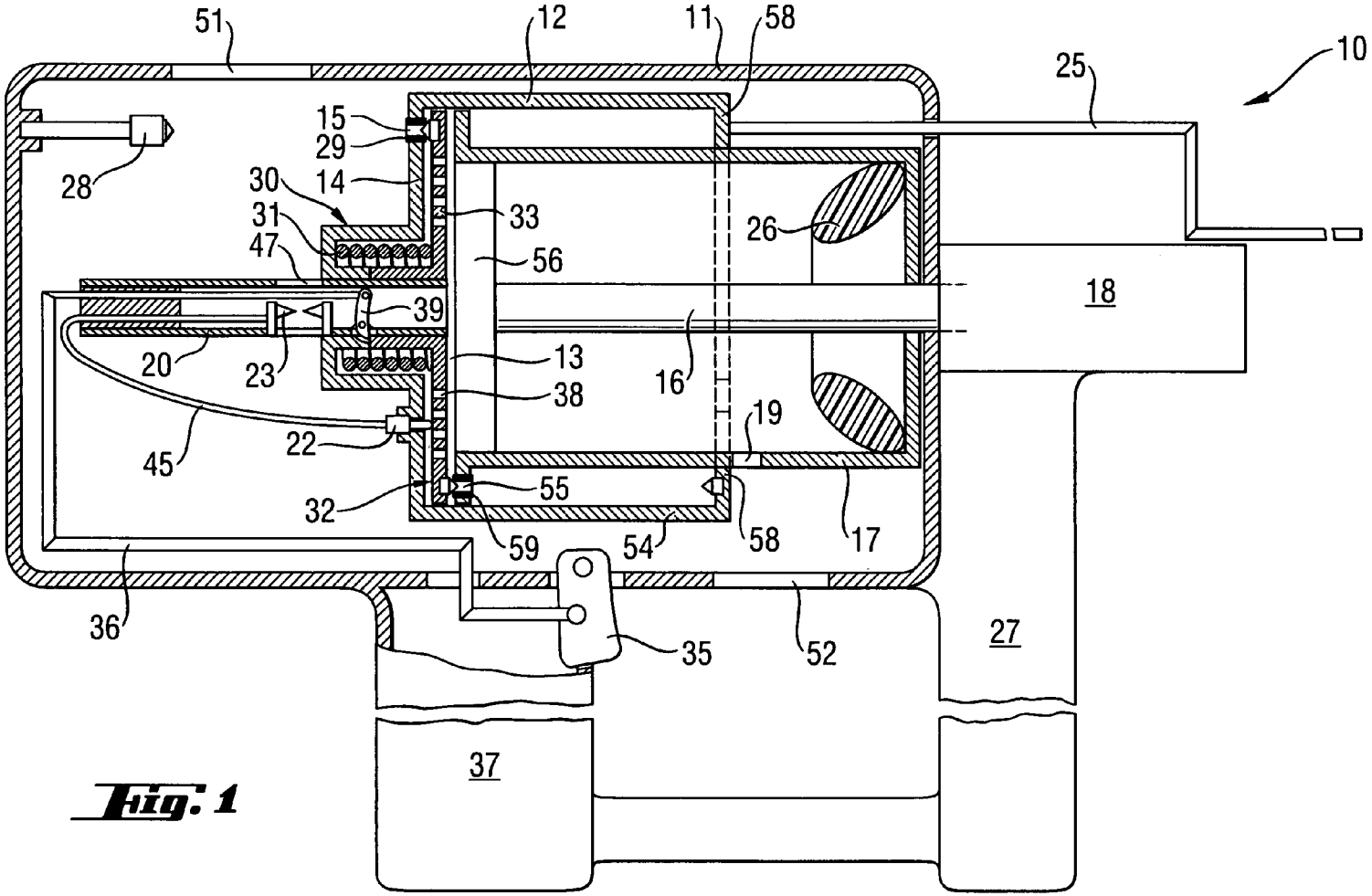
FIG. 1 a longitudinal, partially cross-sectional view of a setting tool according to the present invention in an inoperative position.

In FIG. 1, the setting tool 10 is shown in its initial or inoperative position. The setting tool 10 has a housing 11 in which there is arranged a setting mechanism with which a fastening element such as a nail, a bolt or the like can be driven in a constructional component U (FIGS. 2–6) when the setting tool 10 is pressed against the constructional component U and is actuated.

The setting mechanism includes, among others, a combustion chamber casing 12 in which a combustion chamber 13 is expandable, a piston guide 17 in which a setting piston 16 is displaceably arranged, and a bolt guide 18 in which a fastening element can be displaced by a setting direction end of the forward movable setting piston 16 and, thereby, be driven in a constructional component. The fastening element can, e.g., be stored in magazine 27 on the setting tool 10.

The combustion chamber 12, is displaceably arranged with respect to the piston guide 17 and is elastically biased by a spring, not shown in the drawings, in a direction toward the bolt guide 18 or in a direction of a collapsed position of the combustion chamber 13 shown in FIG. 1. The setting tool 10 further includes a press-on element 25 which is formed as a bar engaging with one of its end the combustion chamber casing 12, with the opposite end projecting from the housing 11 and extending, in an inoperative position of the setting tool 10 according to FIG. 1, beyond the bolt guide 18. The combustion chamber casing 12 is displaced, medium tight, with its rear wall 14 over a tubular element 20 in which an ignition element 23, such as a spark plug, is arranged and in which a fuel conduit 21 is arranged. The fuel conduit 21 is connected with a fuel reservoir, not shown in the drawings, e.g., a liquid gas capsule. In the region of the ignition element 23, the tubular element 20 has at least one opening 47 through which fuel 50 can flow in the combustion chamber 13 (please see FIG. 2) and through which a air-fuel mixture can reach the ignition element 23.

An electrical conductor 45 connects the ignition element 23 with switch means 22, such as a conventional switch or with a piezoelectrical element which an ignition process is actuated.

Figure 2:
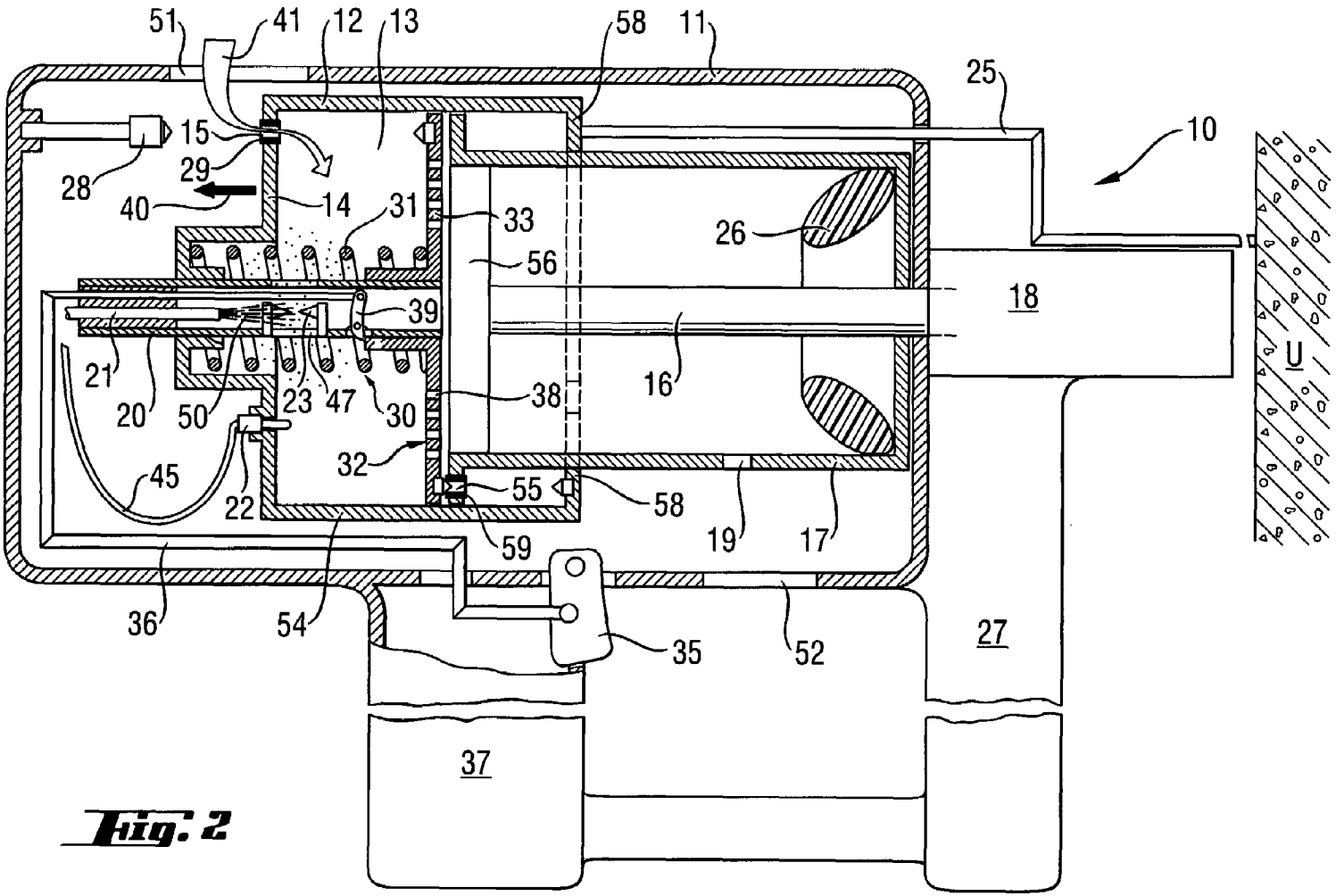
FIG. 2 a longitudinal, partially cross-sectional view of the setting tool shown in FIG. 1 in a position in which the tool is slightly pressed against a constructional component.

Through an air inlet 51 in the housing 11 and an inlet opening 15 in the rear wall 14 of the combustion chamber 13, air can be brought in to the combustion chamber 13 (as shown with arrow 41) when the combustion chamber expands as a result of displacement of the combustion chamber casing 12 in the direction of arrow 40 (please see FIG. 2).

In the expanded condition of the combustion chamber casing 12 or the combustion chamber 13, a mechanical device, which is generally designated with a reference numeral 30, for a pulsed acceleration of turbulence generating means 32 is activated. The turbulence generating means 32 is formed as a turbulence generating plate 33 provided with openings 38. The mechanical device 30 includes a force storing element 31 which is formed as a spring engaging, with one of its end, the turbulence generating plate 33 and with its other end, the rear wall 14 of the combustion chamber 13. The turbulence generating means 32 or the turbulence generating plate 33 is displaced substantially friction-free along the tubular element 20 and is sufficiently spaced from the cylindrical wall 54 of the combustion chamber casing 12, so that no friction losses occur during displacement of the turbulence generating means 32 or plate 33 in an axial direction in the combustion chamber 13.

In the initial or inoperative position of the setting tool 10 shown in FIG. 1, the turbulence generating plate 33 and the rear wall 14 are located directly adjacent to each other at an end of the piston guide 17 remote from the bolt guide 18. The space of the combustion chamber 13 is reduced to a minimal gap, and the combustion chamber 13 is in collapsed condition.

When the setting tool 10, as shown in FIG. 2, is put against a constructional component U, firstly, the free end of the press-on element 25 contacts the constructional component U. With the setting tool 10 being pressed against the constructional component U, the combustion chamber casing 12 is displaced in the direction of arrow 40 away from the piston guide 17, whereby the combustion chamber 13 expands. However, the turbulence generating plate 33 is not yet displaced but remains rather at the end of the piston guide 17 and is held there by a locking member 39. A switch rod 36 connects the locking member 39 with an actuation switch 35 provided on a handle 37 of the setting tool 10.

During the expansion process of the combustion chamber 13, on one hand, air flows into the combustion chamber 13 through the air inlet 51 and the inlet opening 15 in the direction of arrow 41 and, on the other hand, fuel 50 is fed into the combustion chamber 13 through the fuel conduit 21. The fuel conduit 21, only a section of which is shown in FIG. 2, is connected with a fuel reservoir, not shown. Metering of the fuel can be effected with a metering device which can be controlled mechanically or electronically. When the setting tool 10, as shown in FIG. 3, is completely pressed against the constructional component U, the inlet opening 15, at the edge of which a sealing element 29 is provided, is closed by a seal 28, which can be provided, e.g., in the housing 11.

Figure 3:
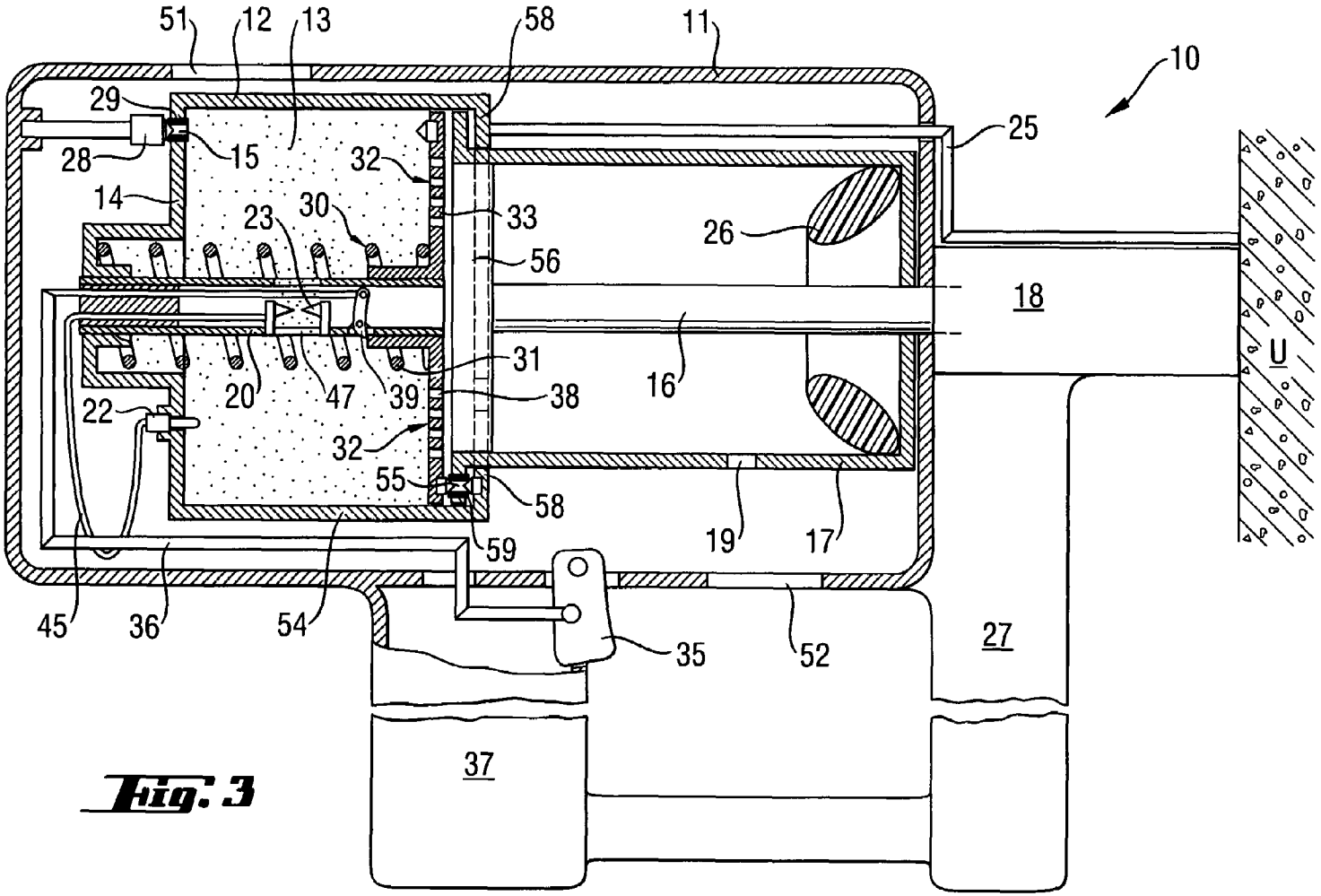
FIG. 3 a longitudinal, partially cross-sectional view of the setting tool shown in FIG. 1 in a position in which the tool is completely pressed against a constructional component.

FIG. 3 shows the combustion chamber 13 in a completely expanded condition. However, the actuation switch 35 is not yet actuated. Air and gaseous fuel fills the combustion chamber.

Figure 4:
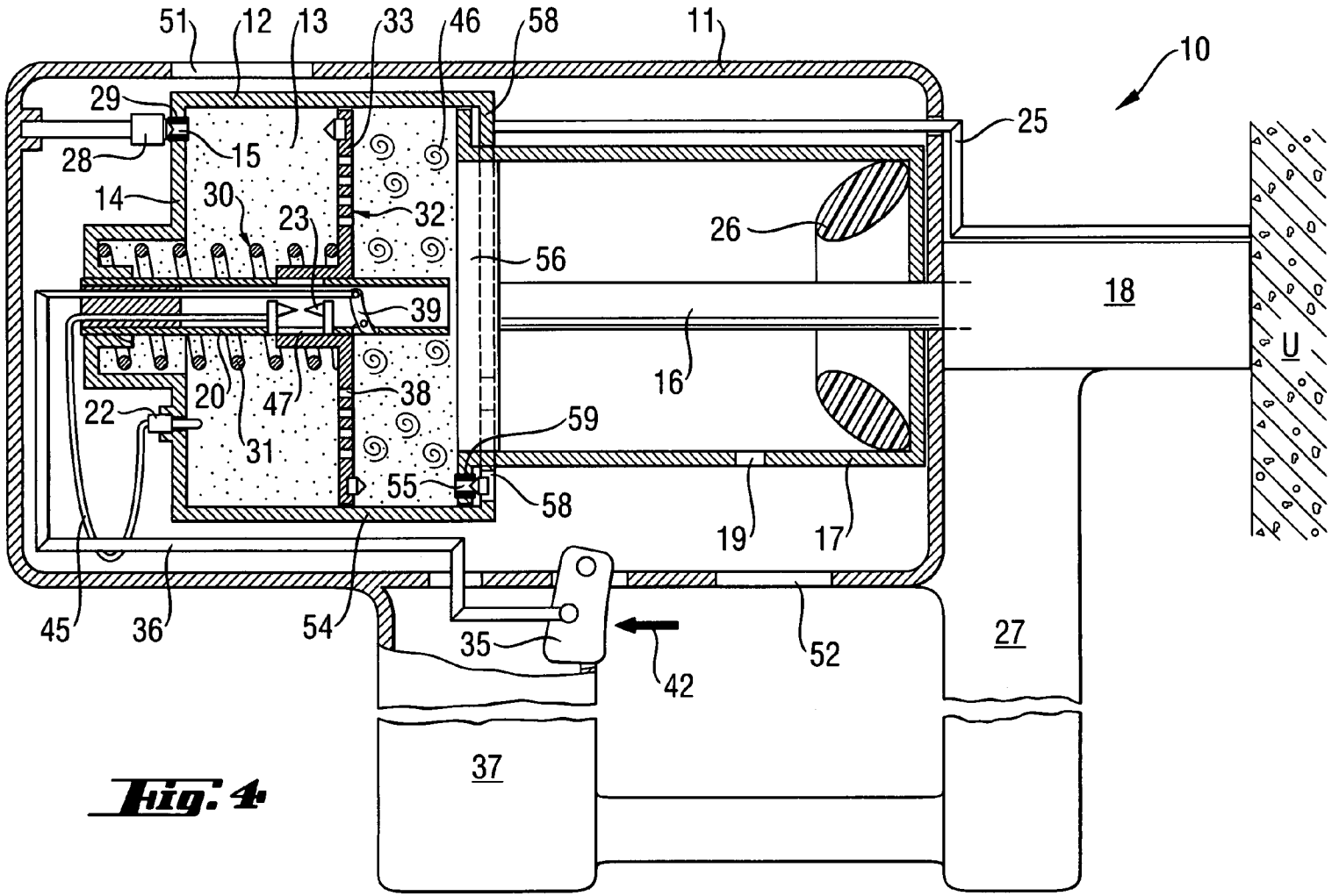
FIG. 4 a longitudinal, partially cross-sectional view of the setting tool shown in FIG. 1 in a position in which the tool is completely pressed against a constructional component, and the trigger is actuated.
Figure 5:
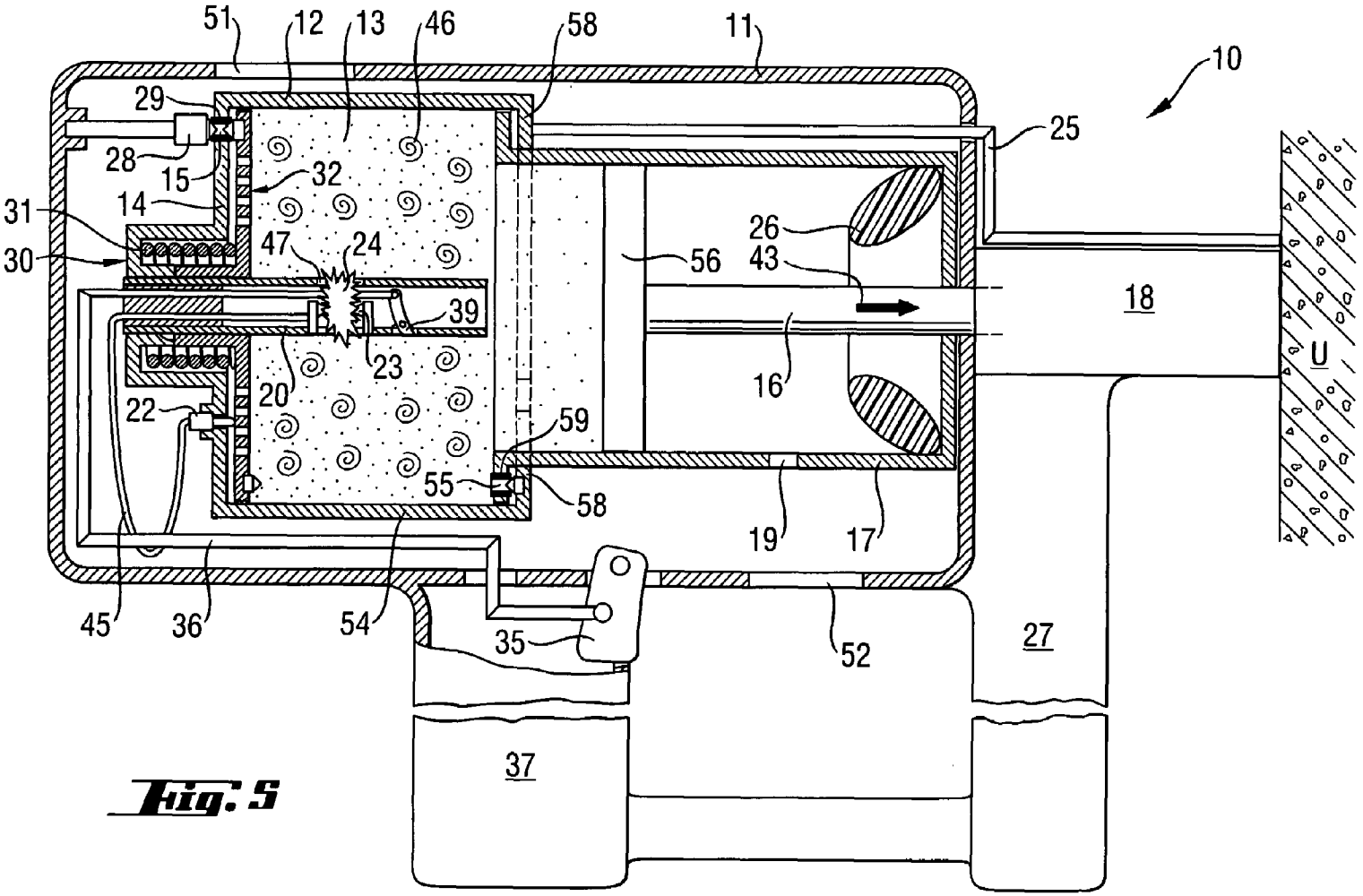
FIG. 5 a longitudinal, partially cross-sectional view of the setting tool shown in FIG. 1, in which the tool is completely pressed against a constructional component, with the ignition having taking place.

In the position of the setting tool 10 shown in FIG. 4, the actuation switch is actuated. The locking member 39 is displaced by the switch rod 36 in its release position, and the turbulence generating plate 33 is displaced in the combustion chamber 13 in the direction of the rear wall 14 under the biasing force of the force storing element 31 with an acceleration from 1 $m/s^2$ to 5,000 $m/s^2$. The displacement of the turbulence generating plate 33 causes a strong turbulence 46 of the air-fuel mixture that fills the combustion chamber 13. The acceleration forces imparted by the force storing element 41 amounts to about from 5 to 30 N.

As the turbulence generating plate 33 approaches the combustion chamber rear wall 14, it actuates the switch means 22. The switch means actuates the ignition element 23, whereby the ignition 24 of the air-fuel mixture takes place. The actuation is effected, e.g., by closing an ignition current circuit or by ignition pulse generated by the switch means 22. The ignition of an air-or other oxidant means-fuel mixture in the combustion chamber can also be effected, e.g., during the pulsed displacement of the turbulence generating means, e.g., by a switch provided at the other location.

At the time of ignition, the air-fuel mixture is subjected to a strong turbulence, whereby a high energy yield of the combustion process is achieved. The setting piston 16 is displaced by expanding combustion gases in the direction of arrow 43 towards the bolt guide 18, driving a fastening element in the constructional component U. At the end of the piston guide 17 adjacent to the bolt guide 18, there is provided an annular damping element 26 that damps or prevents overrun of the setting piston 16 at this end of the piston guide 17.

In the wall of the piston guide 17, there is provided an outlet opening 19 through which a major portion of the combustion gases can reach the exhaust opening 52 in the housing 11 and therethrough be released into environment when the piston plate 56 of the setting piston 16 is located between the outlet opening 19 and the damping element 26.

Figure 6:
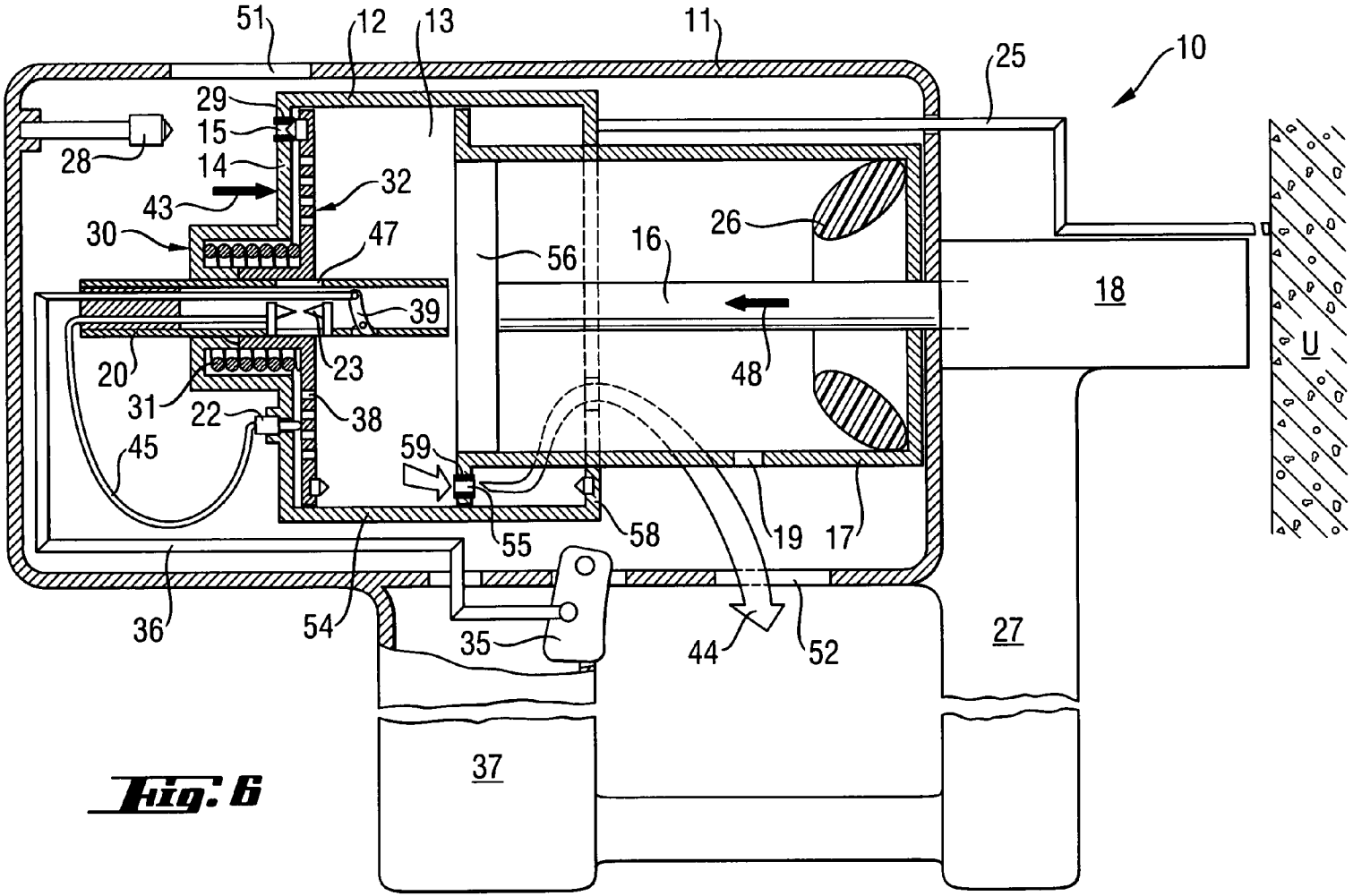
FIG. 6 a longitudinal, partially cross-sectional view of the setting tool shown in FIG. 1, in which the tool has been slightly lifted off the constructional component.

In FIG. 6, the setting piston 16 has already been displaced in the direction of arrow 48 in its initial position. This can take place, e.g., as a result of generation of underpressure which is produced by cooling of residual combustion gases that remain in the combustion chamber, or by a return mechanism, not shown.

FIG. 6 shows a position in which the setting tool 10 is slightly lifted off the constructional component 10. Thereby, an outlet opening 55, which was sealed with a sealing element 59 against an annular wall 58 of the combustion chamber casing 12, opens. The combustion gases, which remain in the combustion chamber 13, can flow through the outlet opening 55 and then through openings, not shown, in the annular wall 58 to the outlet opening 52 in the housing 11 and therethrough into environment, as shown with arrow 44. This process ends when the combustion chamber 13 completely collapses upon the setting tool 10 having been lifted from the constructional component 10, and the setting tool 10 assumes its initial inoperative position shown in FIG. 1. Then again, the turbulence generating plate 33 becomes locked by the locking element 39 on the tubular element 20, and the force storing element 31 becomes loaded (the spring becomes compressed).

Figure 7:
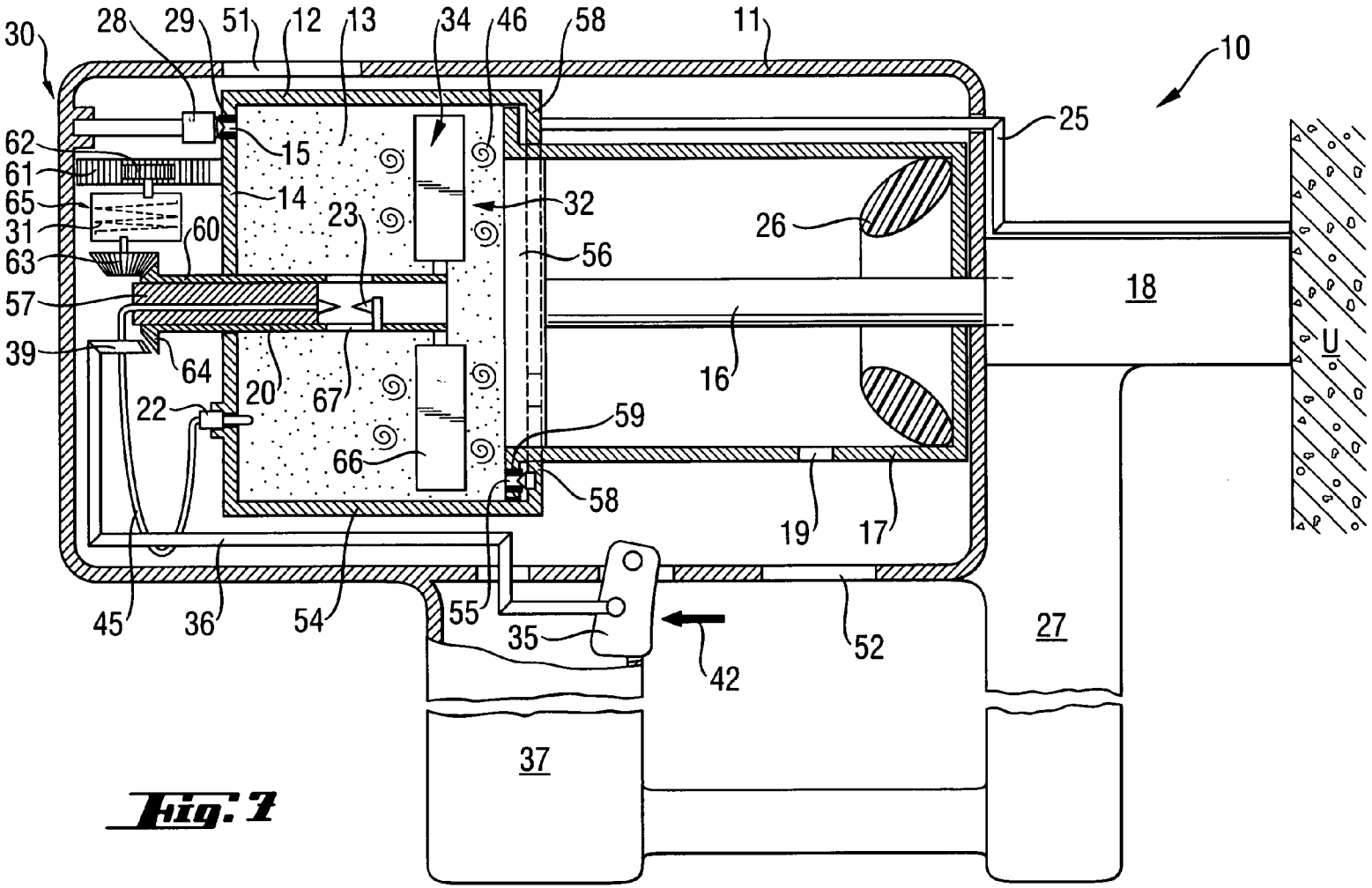
FIG. 7 a longitudinal, partially cross-sectional view of another embodiment of a setting tool according to the present invention in a position in which the tool is completely pressed against a constructional component and the trigger has been actuated.

The setting tool 10, which is shown in FIG. 7, differs from the setting tool 10 shown in FIGS. 1–6 in that the turbulence generating means 32 is formed as a stirring element 34 or a rotor element with a very steeply extending rotor blades 66. Further, the mechanical device 30 for accelerating the turbulence generating means 32 is formed as a gear drive 65 that includes the force storing element 31 which is formed as a spring. The gear drive 65 includes a transmission member 61 arranged on the rear wall 14 of the combustion chamber 13 and which is formed as a tooth sack displaceable together with the combustion chamber casing 12. The transmission member 61 engages a receiving member 62, which is formed as a tooth gear, for transmission of a press-on movement. The receiving member 62 converts the translatory movement of the transmission member 61 in a rotary movement, transmitting the rotary movement into the force storing element 31. Thereby, the press-on displacement of the setting tool 10 against the constructional component U tensions and loads the force storing element 31.

The output side of the force storing element 31 is connected with an output member 63 formed as a tooth gear. The output member 63 engages a receiving member 64 of the stirring element 34 which is formed as a tooth rim provided on a hollow shaft 60. The hollow shaft 60 carries, at its end opposite the tooth rim, rotor blades 66 of the stirring element 34. The hollow shaft 60 is rotatably supported on a support pin 57 that also carries the ignition unit 23. The hollow shaft 60 extends through the rear wall 14 or is additionally supported in the rear wall 14. In the region of the ignition unit 23, there is provided in the hollow shaft 60 at least one opening 67 that performs the same function as the opening 47 in the previously described embodiment of the inventive setting tool 10 (ignition, flow of fuel into the combustion chamber).

As in the previous embodiment, a locking member 39 is provided on the switch rod 36 and which in non-actuated condition of the actuation switch 35, engages the receiving member 64, preventing rotation of the stirring element 34.

When the setting tool 10 is completely pressed against the constructional component U, as shown in FIG. 7, the force storing element 31 is, as it has already been discussed before, completely loaded. When, as shown in FIG. 7, the actuation switch is actuated, by being displaced in the direction of the arrow 42, the locking member 39 is displaced from its engagement position with the receiving member 64, releasing the hollow shaft 60. The force storing member 31 can now be unloaded, with the output member 63 imparting a rotational movement to the stirring element 34. With the stirring element 34, a large turbulence 46 is imparted to the air-fuel mixture which by that time has been delivered into the combustion chamber 13. The switch means 22 can be formed as a flow sensor that would actuate the ignition unit 23 for igniting the air-fuel mixture when a predetermined degree of turbulence is reached.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving a fastening element in a constructional component, comprising:

an actuation switch (35) for actuating a setting process;

a combustion chamber (13) for combusting therein an oxidant-fuel mixture;

turbulence generating means (32) arranged in the combustion chamber (13) for creating turbulence of the oxidant-fuel mixture; and drive means for at least partially driving the turbulence generating means (32), the drive means including a mechanical device (30) for a pulsed acceleration of the turbulence generating means (32) activatable by the actuation switch (35).

2. A setting tool according to claim 1, wherein the mechanical device (30) imparts a pulsed acceleration in a range from 1 $m/s^2$ to 5,000 $m/s^2$ to the turbulence generating means (32).

3. A setting tool according to claim 2, wherein the mechanical device (30) imparts a pulsed acceleration of at least 25 $m/s^2$ to the turbulence generating means (32).

4. A setting tool according to claim 1, wherein the mechanical device (30) comprises a force storing element (31).

5. A setting tool according to claim 4, wherein the force storing element (31) is formed as a spring.

6. A setting tool according to claim 4, wherein the force storing element (31) applies an acceleration force of from 1 to 50 N to the turbulence generating means (32).

7. A setting tool according to claim 1, wherein the turbulence generating means (32) is displaced in the combustion chamber (13) substantially friction-free.

8. A setting tool according to claim 1, wherein the turbulence generating means (32) is formed as a turbulence generating plate (33) axially displaceable in the combustion chamber (31).

9. A setting tool according to claim 8, wherein the turbulence generating plate (33) is provided with through-openings (38).

10. A combustion-engined setting tool for driving a fastening element in a constructional component, comprising:

an actuation switch (35) for actuating a setting process;

a combustion chamber (13) for combusting therein an oxidant-fuel mixture;

turbulence generating means (32) arranged in the combustion chamber (13) for creating turbulence of the oxidant-fuel mixture, wherein the turbulence generating means (32) is formed as a rotatable stirring element (34); and drive means for at least partially driving the turbulence generating means (32), the drive means including a mechanical device (30) for a pulsed acceleration of the turbulence generating means (32) activatable by the actuation switch (35).

11. The combustion-engined setting tool according to claim 10, wherein the mechanical device (30) imparts a pulsed acceleration in a range from 1 $m/s^2$ to 5,000 $m/s^2$ to the turbulence generating means (32).

12. The combustion-engined setting tool according to claim 11, wherein the mechanical device (30) imparts a pulsed acceleration of at least 25 $m/s^2$ to the turbulence generating means (32).

13. The combustion-engined setting tool according to claim 10, wherein the mechanical device (30) comprises a force storing element (31).

14. The combustion-engined setting tool according to claim 13, wherein the force storing element (31) is formed as a spring.

15. The combustion-engined setting tool according to claim 13, wherein the force storing element (31) applies an acceleration force of from 1 N to 50 N to the turbulence generating means (32).

16. The combustion-engined setting tool according to claim 13, comprising a press-on member (25) for loading the force storing element (31).

17. The combustion-engined setting tool according to claim 10, wherein the turbulence generating means (32) is displaced in the combustion chamber (13) substantially friction-free.

18. The combustion-engined setting tool according to claim 10, wherein the turbulence generating means (32) is formed as a turbulence generating plate (33) axially displaceable in the combustion chamber (31).

19. The combustion-engined setting tool according to claim 18, wherein the turbulence generating plate (33) is provided with through-openings (38).

20. A combustion-engined setting tool for driving a fastening element in a constructional component, comprising:

an actuation switch (35) for actuating a setting process;

a combustion chamber (13) for combusting therein an oxidant-fuel mixture;

turbulence generating means (32) arranged in the combustion chamber (13) for creating turbulence of the oxidant-fuel mixture;

drive means for at least partially driving the turbulence generating means (32), the drive means including a mechanical device (30), comprising a force storing element (31), for a pulsed acceleration of the turbulence generating means (32) activatable by the actuation switch (35); and a press-on member (25) for loading the force storing element (31).

* * * * *